US005246210A

United States Patent [19]

Dabney et al.

[11] Patent Number: 5,246,210

[45] Date of Patent: Sep. 21, 1993

[54] GRID AND SPRING SUBASSEMBLY FOR BOX SPRINGS

[75] Inventors: Upton R. Dabney, Georgetown; William C. Rodgers, Lexington, both of Ky.

[73] Assignee: Hoover Group, Inc., Alpharetta, Ga.

[21] Appl. No.: 896,993

[22] Filed: Jun. 11, 1992

[51] Int. Cl.[5] ..... F16F 3/00

[52] U.S. Cl. ..... 267/103; 267/107; 5/247; 5/255; 5/267; 5/272

[58] Field of Search ..... 267/144, 103, 104, 105, 267/106, 107, 108, 109, 111; 5/267, 272, 273, 255, 247

[56] References Cited

U.S. PATENT DOCUMENTS

| | | | |
|---|---|---|---|
| 3,577,574 | 5/1971 | Ciampa et al. | 5/267 |
| 4,339,834 | 7/1982 | Mizelle | 267/103 X |
| 4,666,136 | 5/1987 | Hagemeister | 267/103 |
| 4,838,528 | 6/1989 | Hagemeister | 267/103 |
| 4,896,386 | 1/1990 | Ogle et al. | 5/247 |
| 4,921,228 | 5/1990 | Lowe | 267/103 |
| 4,932,535 | 6/1990 | Dabney | 267/103 |
| 5,152,509 | 10/1992 | Wells et al. | 267/103 |

*Primary Examiner*—Robert J. Oberleitner
*Assistant Examiner*—Kevin D. Rutherford
*Attorney, Agent, or Firm*—Harness, Dickey & Pierce

[57] ABSTRACT

A spring and grid sub-assembly for use in furniture and box spring assemblies in which spring modules are attached to the wire grid through an attachment system in which the springs are in both an over-under relationship and a side-to-side interwoven relationship with the cross wires through plastic deformation of the cross wires whereby the springs can not be removed from the wire grid without plastic deformation of either the grid or spring modules. The resultant sub-assembly can be easily transported from a sub-assembler to a final assembler without risk of the springs being displaced or removed from the wire grid. Furthermore, spring clips are not needed for attaching the spring modules to the grid.

11 Claims, 3 Drawing Sheets

GRID AND SPRING SUBASSEMBLY FOR BOX SPRINGS

BACKGROUND AND SUMMARY

This invention relates generally to grid and spring subassemblies for bedding and furniture foundations for mattresses and seat cushions. Foundations for mattresses, typically referred to as box spring assemblies, conventionally consist of a support frame, a wire grid positioned above the support frame, and springs supporting the grid on the frame for yieldable movement under load toward the frame.

The metal components of a box spring assembly include the springs and the grid and in some cases the support frame. In this invention, the springs and grid are assembled into a subassembly which is supplied to the bedding or furniture manufacturer for final assembly and ultimate sale. In the case of box spring assemblies, various sizes and grades are made by the manufacturer and this requires the maintenance by the furniture manufacturer of a large inventory of metal component subassemblies. It is necessary that the spring subassemblies be assembled in such a manner that the springs will not become detached from the grid or move out of the proper position on the grid during transport and handling. One way of assuring that the springs stay attached to the grid is to use clips to attach the springs to the grid. However, the use of clips, of which several are needed for a box spring assembly, dramatically increases the number of components needed in the metal subassembly. In addition, certain types of loading applied directly to a cross wire can cause the clips to open and the springs to loosen from the grid.

Box spring assemblies have been developed in which the springs and the wire grid are interfit with one another in an "over and under" relationship with the grid to attach the spring to the grid. However, until the lower ends of the springs are attached to the support frame, it is possible to move the springs out of the desired position on the grid by inadvertent contact with the springs. It is also possible to inadvertently remove the springs from the grid. Such detachment or movement creates difficulties when the spring and grid subassembly is attached to the support frame due to misposition or loss of the springs. Examples of interfitting spring and grid subassemblies are shown in U.S. Pat. Nos. 4,339,834; 4,921,228 and 4,932,535.

It is an object of the present invention to provide a grid and spring subassembly in which the springs are secured to the grid without spring clips but in a manner which assures retention of the springs on the grid at all times.

Because spring and grid subassemblies must be transported from the subassembler to the final furniture assembler, it is beneficial if the subassemblies are stackable. Examples of stackable subassemblies are shown in co-pending patent applications Ser. No. 07/628,086 filed Dec. 17, 1990 entitled NESTABLE SPRING ASSEMBLIES FOR BEDDING AND FURNITURE and Ser. No. 07/656,585 filed Feb. 19, 1991 entitled STACKABLE SPRING ASSEMBLIES WITH FORMED WIRE SPRING MODULES. Both of these applications are commonly assigned with the present application and are hereby incorporated by reference.

According to the present invention, the grid cross wires are formed with periodic vertical offsets. The upper ends of the springs include attaching portions that are configured with at least one pair of segments in each spring transverse to the cross wire. These transverse segments are connected by a return bent portion so as to enable the spring attaching portion to be interfit with the cross wire at the vertical offset with one transverse segment overlying the vertically offset of the cross wire and the other transverse segment underlying the cross wire adjacent the vertical offset.

The cross wire is seated in the return bent portion between the two transverse segments. This interfitting engagement is accomplished by moving the spring attaching portion horizontally into engagement with the cross wire. In the engaged position, a longitudinal segment of the spring attaching portion extends parallel to the vertical offset of the cross wire but is vertically above the offset and horizontally to one side of the offset, opposite from the return bent portion.

After engagement, the vertical offset is plastically deformed vertically to a position along side a longitudinal segment of the spring attaching portion to entrap the longitudinal segment on the opposite side of the cross wire from the return bent portion of the spring attaching portion. This prevents withdrawal of the spring attaching portion from engagement with the cross wire in a direction normal to the cross wire while the over-under engagement relationship of the spring attaching portion to the cross wire prohibits movement in all other directions.

The plastic deformation of the cross wire offset results in a permanent attachment of the spring to the cross wire. The spring can only be detached from the cross wire by permanent deformation of the cross wire.

Preferably, the springs are configured in a V-shape to enable a plurality of grid and spring subassemblies to be stacked one upon the other with the lower portion of the spring being inserted into the rectangular pockets formed between cross wires in the grid stacked below.

Further objects, features and advantages of the invention will become apparent from a consideration of the following description and the appended claims when taken in connection with the accompanying drawings.

DETAILED DESCRIPTION OF THE INVENTION

Figure 1:
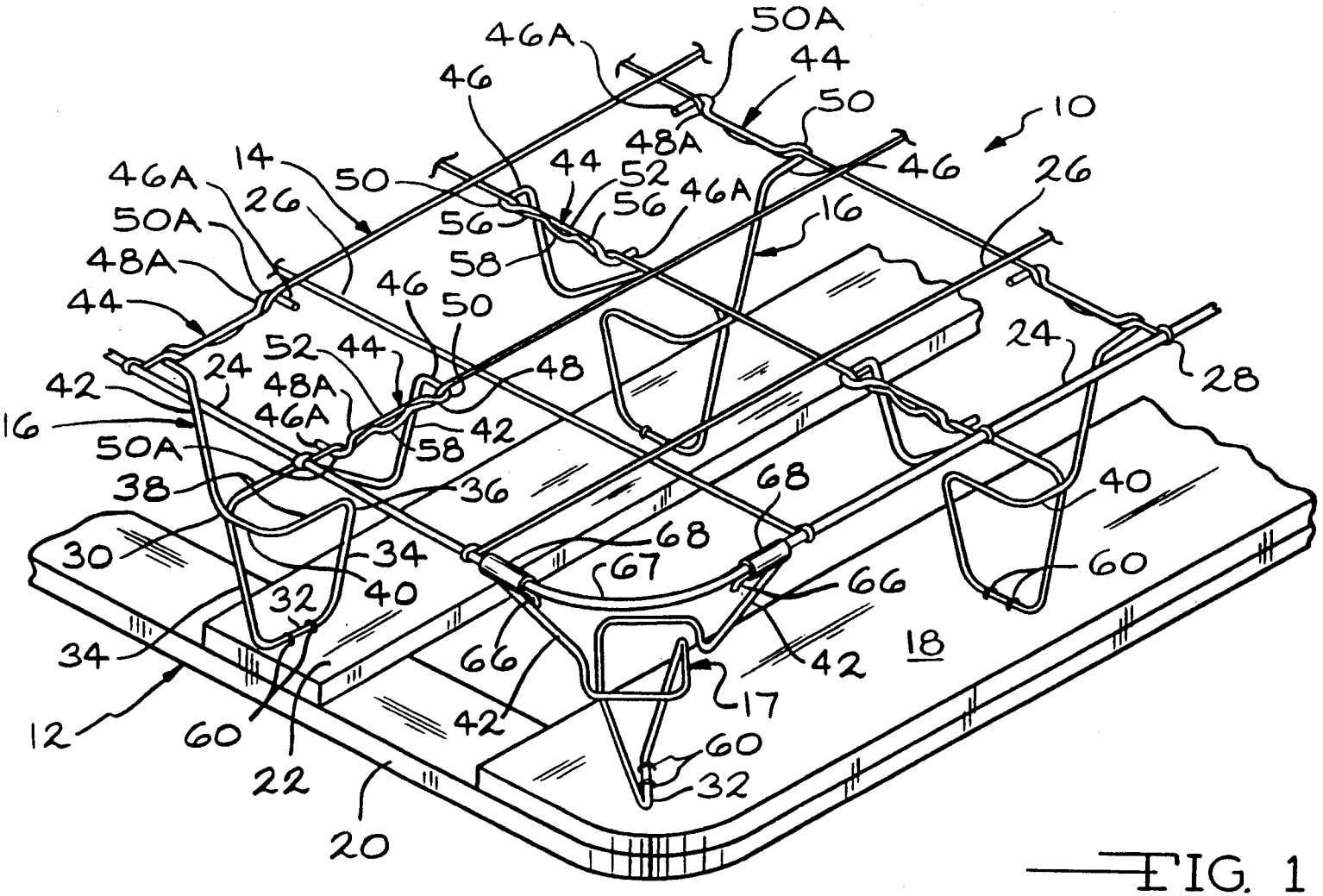
FIG. 1 is a fragmentary perspective view of the spring and grid sub-assembly of this invention mounted to a support frame.

With reference to the drawing, the spring and grid sub-assembly of this invention, indicated generally at 10, is illustrated in FIG. 1 mounted on a supporting frame 12. Only a portion of the subassembly is illustrated but it is of generally rectangular shape. The subassembly 10 consists of a wire grid 14, also of rectangular shape, a plurality of main spring modules 16 and corner spring modules 17 which are attached to the wire grid 14. When the spring modules 16 are mounted on the frame 12, they act to support the grid 14 at a predetermined elevation above the frame 12 and in general alignment therewith.

The frame 12 consists of a pair of end rails 18, a pair of side rails 20, and a plurality of cross rails 22. The frame 12 is conventional so only one of each of the rails is illustrated in FIG. 1. The wire grid 14 consists of a rectangular border wire 24 and a plurality of cross wires 26 which are arranged in a criss-cross fashion and are supported on the border wire 24. In the illustrated embodiment of the grid 14, the cross wires 26 are illustrated as having return bent portions forming loops 28 at their ends which are bent around the border wire in order to support the cross wires on the border wire 24.

The spring modules 16 are identical and are each formed of a single piece of conventional spring wire folded, in the preferred embodiment of this invention, to be generally V-shaped. Each of the spring modules 16 includes a body 30 formed of spring wire which is generally upright and has a support torsion bar 32 at its lower end or apex attached to the frame 12 by staples 60. A pair of straight upwardly diverging columns 34 extend upwardly from opposite ends of the bar 32 and are formed integral at their upper ends 36 with oppositely extending generally parallel torsion bars 38. The torsion bars 38 are formed integral with generally horizontal connecting bars 40 which terminate in upwardly diverging support arms 42.

At the upper end of the body 30, the spring module 16 is formed with a pair of horizontally spaced apart attaching portions 44 which are integral with the support arms 42. The attaching portions 44 and the cross wires 26 are configured so that they can be interlocked to provide a clipless attachment of the spring modules 16 to the grid 14. The spring modules 16 are connected to the grid 14 so that up and down movement of the grid 14 in response to bedding loads results in corresponding substantially vertical compression and expansion of the spring modules 16 in reaction to the loads.

Each attaching portion 44 includes, adjacent to the upright support arm 42, a pair of transverse segments 46 and 48 which extend generally transverse to the cross wire 26 to which the spring module is attached. The two transverse segments 46 and 48 are connected by a return bent segment 50 which is characterized as being generally parallel to the cross wire 26. A longitudinal segment 52 of the attaching portion 44 extends parallel to the cross wire 26 from one end of transverse segment 48. At the opposite end of the longitudinal segment 52, the wire is bent to form another pair of transverse segments 46A and 48A joined by a return bent segment 50A. The transverse segments 46A and 48A and return bent segment 50A are mirror images of the transverse segments 46 and 48 and return bent segment 50. The entire attaching portion 44, consisting of the longitudinal segment 52, the transverse segments and the return bent segments, lies in a common horizontal plane.

The cross wires 26 are formed with vertical offsets 54, at the locations of spring attachment. Each offset 54 has a pair of first offset segments 56 which are aligned with one another and a second center offset segment 58 therebetween. The offset 54 is joined to the main portion of the cross wire 26 by risers 62. The main portion of the cross wire, the risers 62 and vertical offset 54 are in a common vertical plane.

Figure 2:
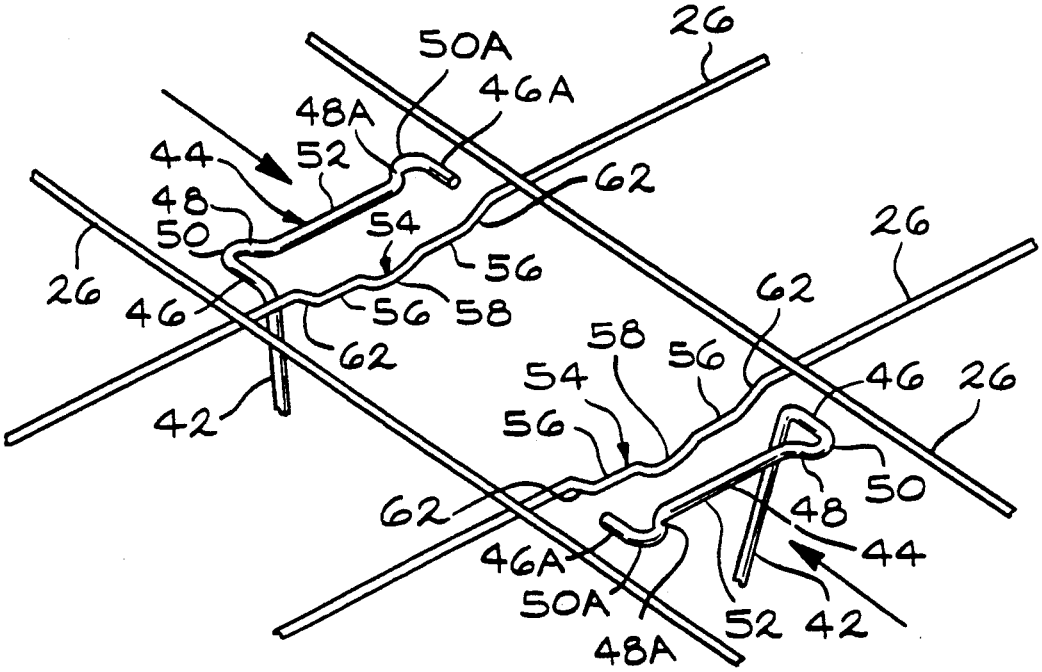
FIG. 2 is a fragmentary perspective view of the attaching portions of a spring and the grid during assembly.

The spring modules are attached to the grid by spreading the two spring attachment portions 44 away from one another to the position shown in FIG. 2 in which the spring attaching portions are separated by more than the distance between the two cross wires 26 to which the spring module is attached. Once the grid is positioned in alignment with the spring attaching portions, the spring attaching portions are allowed to return toward their normal positions whereby the spring attaching portions move toward one another into engagement with the cross wires.

The attaching portions move horizontally in the direction of the arrows shown in FIG. 2 which is generally parallel to the lengths of the transverse segments. The spring attaching portions engage the cross wires in an interfitting relationship in which the transverse segments 46 and 46A underlie the cross wire while the transverse segments 48 and 48A overlie the first offset segments 56 of the cross wire with the risers 62 being seated in the bent return segment 50 of the spring attaching portions 44.

In this interfitting position, the pairs of transverse segments 46 and 48 and 46A and 48A engage opposite vertical sides of the cross wire 26 and opposite horizontal sides of the risers 62 in the longitudinal direction of the cross wire. The spring module 16 is restrained from moving horizontally along the length of the cross wire 26 and vertically due to the over-under relationship of the transverse segments with the cross wire.

Figure 3:
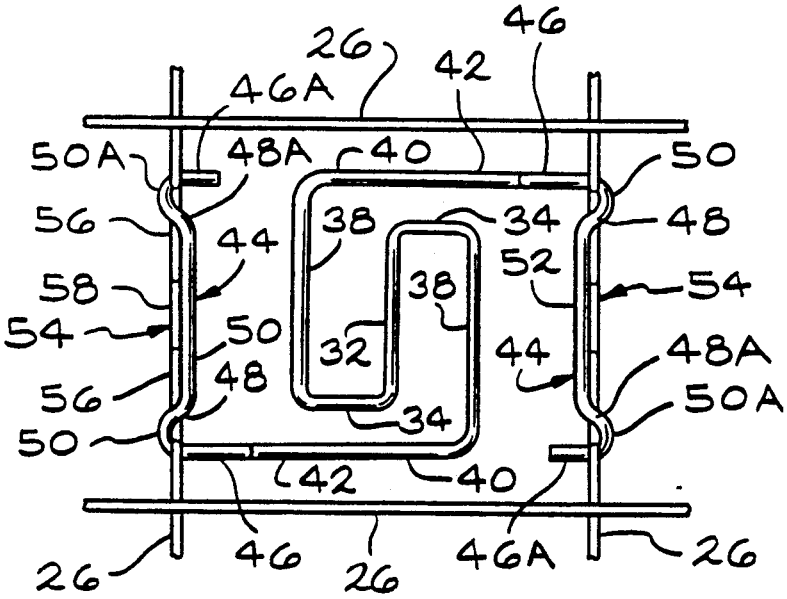
FIG. 3 is a fragmentary plan view of a spring and the wire grid assembled.
Figure 4:
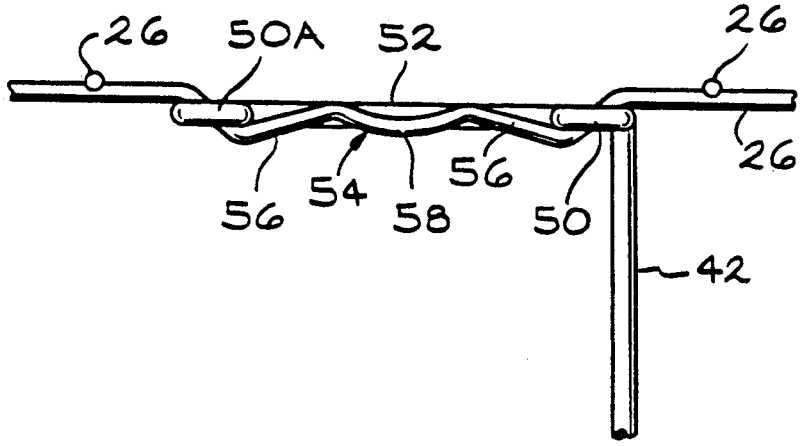
FIG. 4 is a fragmentary elevational view of the structure shown in FIG. 3.

The transverse segments 48 and 48A are of a length transverse to the cross wire 26 approximately equal to the diameter of the cross wire 26 such that when the attaching portion is engaged with the cross wire, the longitudinal segment 52 of the attaching portion is positioned on the opposite horizontal side of the cross wire 26 from the return bent segment 50. This relationship is shown in the plan view of FIG. 3.

To interlock the spring module with the cross wire so that the spring module is restrained in all directions, the vertical offset portion 54 is deflected upward by application of a vertical load to the second offset segment 58. The second offset segment 58 is curved. During upward deflection, the radius of curvature of segment 58 is increased as the offset segments 56 are deflected upward, using spring sections 48 and 48A as a fulcrum point so that the spacing between the two risers 62 remains the same.

The vertical offset 54 is plastically deformed beyond its elastic limit so as to remain in the deflected position adjacent to the longitudinal segment 52 of the spring attaching portion 44. In this position, the offset portion serves as a mechanical lock to prevent horizontal displacement of the spring attaching portion from the cross wire. the spring module can not be removed from the grid without subsequent plastic deformation of the cross wire or the spring attaching portion. The spring will thus remain attached to the wire grid during handling and transport of the spring and grid sub-assembly from one location to another.

Each of the spring attaching portions 44 is independent of the other, they are not in a working association with one another. The attaching portions will function if the support bar 32 were separated to form two springs. The spring module 16 functions as two springs in combination. The use of two attaching portions for each spring module does prevent rotation of the spring module about the cross wire which could occur if the spring module had only one attaching portion.

The corner spring modules 17 are similar to the main spring modules 16 but differ in terms of their attachment to the grid 14. Like numerals are used on the corner spring modules 17 to indicate like parts on the main spring modules 16. At their upper ends, the support arms 42 in the corner spring modules are formed with attaching bars 66 instead of the attaching portions 44. The attaching bars 66 in each corner spring module 17 are generally perpendicular to each other and extend generally toward each other. This configuration of the attaching bars 66 enables them to be positioned in a side-by-side relation with the border wire 24 at a corner 67 of the border wire, as shown in FIG. 1. Conventional spring clips 68 are utilized to clamp the attaching bars 52 to the side-by-side portions of the border wire 24 and assure a stable positioning of the corner spring module 17 at a corner of the border wire.

Figure 5:
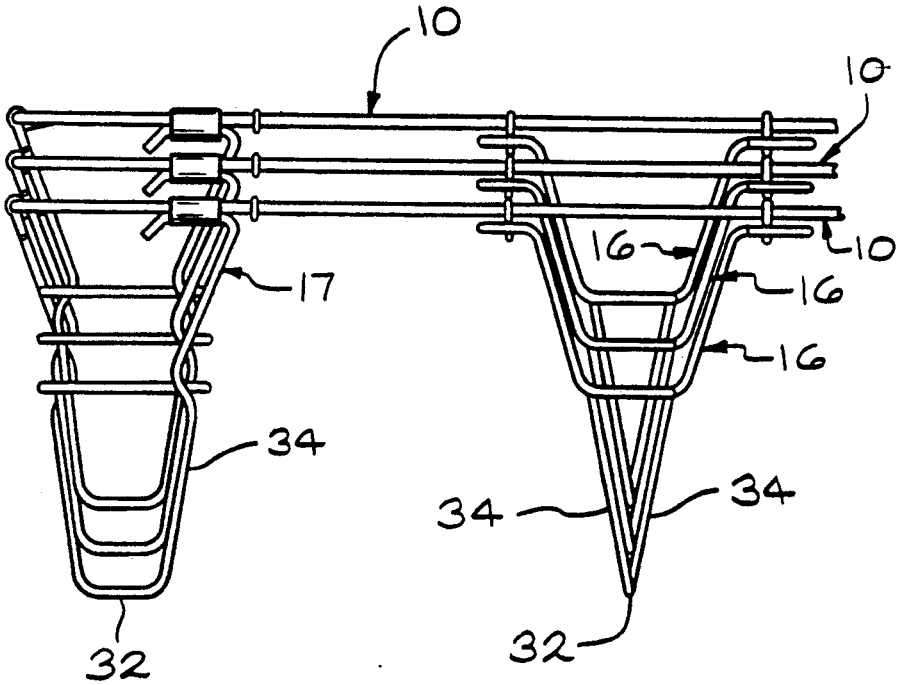
FIG. 5 is a fragmentary elevational view of a nested stack of three spring and grid sub-assemblies according to this invention.

From the above description, it is seen that a spring and grid sub-assembly 10 is formed by assembling a plurality of main spring modules 16 with the wire grid 14, the exact number of spring modules 16 to be used being dependent entirely on the assembler. Large numbers of identical assemblies 10 can be arranged in vertical stacks, as shown in FIG. 5. Nested bundles of sub-assemblies 10 can be palletized and stacked to whatever height and configuration is best suited to the particular transportation mode that is being utilized .

While the V-shape configuration of the spring modules is preferred because it facilitates stacking of the spring and grid sub-assemblies, the configuration of the attaching portions 44 and cross wires 26 of the present invention can be used with spring modules in which the body 30 of the modules is different from the spring modules 16 illustrated and described.

The greatest utility in the spring attaching system is in situations where the subassembly 10 must be transported from the place of subassembly to the place of completion of the assembly with the support frame 12. The attachment system of this invention provides a clipless attachment of the spring modules to the wire grid with assurance that the spring modules will remain in place.

It is to be understood that the invention is not limited to the exact construction illustrated and described above, but that various changes and modifications may be made without departing from the spirit and scope of the invention as defined in the following claims.

We claim:

1. A wire subassembly for use in a foundation for bedding and furniture comprising:

a grid including a border wire and cross wires arranged in a criss-cross pattern on said border wire;

a plurality of upright formed wire spring modules arranged in a predetermined pattern on said grid, each of said spring modules including at least one upper attaching portion for attachment to one of said cross wires of said grid;

said attaching portions of said spring modules and said cross wires being configured for interfitting engagement of said attaching portions and said cross wires in which said spring modules are partially restrained from movement relative to said cross wires;

means associated with said cross wires for enabling said cross wires to be plastically deformed for interlocking engagement to entrap said attaching portions and fully restrain said attaching portions from movement relative to said cross wires;

each attaching portion including a longitudinal segment parallel to the engaged cross wire, a pair of transverse segments transverse to said longitudinal segment at one end of said longitudinal segment and a return bent portion joining said transverse segments; and wherein said engaged cross wire includes an offset vertically spaced from a main portion of said cross wire and connected thereto by a riser, said transverse segments of said attaching portion and said cross wire interfittingly engaging one another with said riser being seated in said return bent portion and with one of said transverse segments overlying said cross wire and the other of said transverse segments underlying said cross wire whereby said spring module attaching portion is restrained from motion relative to said engaged cross wire in a vertical direction and in one horizontal direction normal to said transverse segments.

2. The subassembly of claim 1 wherein said return bent portion and said longitudinal segment of said attaching portion are spaced apart approximately the diameter of said cross wire whereby when said attaching portion is interfittingly engaged with said cross wire, said longitudinal segment and said return bent portion are on opposite horizontal sides of said cross wire, and wherein said vertical offset portion is plastically deformable in a vertical direction into the horizontal plane of said attaching portion to interlockingly engage said attaching portion.

3. The subassembly of claim 2 wherein said vertical offset includes a pair of straight segments spaced vertically below said main portion by a pair of risers, and a downwardly concave curved offset segment between said pair of longitudinal segments, whereby said vertical offset can be plastically deformed upwardly to interlockingly engage said cross wire.

4. The subassembly of claim 1 wherein each attaching portion of said spring modules lies within a horizontal plane and each cross wire of said grid lies within a vertical plane.

5. The subassembly of claim 1 wherein each attaching portion includes a second pair of transverse segments at an opposite end of said longitudinal segment joined by a second return bent portion.

6. For use in a foundation assembly, an article of manufacture comprising:

a grid including a border wire and cross wires arranged in a criss-cross pattern on said border wire;

a plurality of upright formed wire spring modules arranged in a predetermined pattern on said grid, each of said spring modules including at least one attaching portion for interlocking engagement of said spring modules to one of said cross wires by engaging vertically and horizontally opposite sides of said one cross wire, each attaching portion being substantially within a horizontal plane and each of said cross wires lying substantially within a vertical plane and including vertical offsets, each attaching portion engaging vertically opposite sides and one horizontal side of said one of said cross wires in an interfitting position of said spring module with said one cross wire; and means associated with said one cross wire for enabling said one cross wire to be plastically deformed in a vertical direction so that said spring attaching portion engages both horizontal sides of said one cross wire to interlock one of said spring modules with said one cross wire.

7. The article of manufacture according to claim 6 wherein said spring modules are each formed of a single piece of formed spring wire and include two attaching portions, one at each end of said formed spring wire, with said attaching portions being interlockingly engaged with spaced parallel cross wires.

8. The article of manufacture according to claim 7 wherein each attaching portion includes a pair of segments transverse to the engaged cross wire and a pair of segments parallel to said engaged cross wire in an alternating series of transverse segment, parallel segment, transverse segment and parallel segment with said pair of transverse segments engaging opposite vertical sides of said engaged cross wire and said parallel segments engaging opposite horizontal sides of said engaged cross wire with the engaged cross wire including a vertically bent portion between the two transverse segments of each attaching portion whereby said attaching portions are interlockingly engaged with said engaged cross wires to prevent relative movement therebetween.

9. The article of manufacture according to claim 7 wherein each attaching portion includes four segments transverse to said engaged cross wire and three segments generally parallel to said engaged cross wire in an alternating series of transverse segment, parallel segment, transverse segment, parallel segment, transverse segment, parallel segment and transverse segment with a first pair of transverse segments engaging vertically opposite sides of said engaged cross wire and a second pair of transverse segments engaging vertically opposite sides of said engaged cross wire and first and third parallel segments being on an opposite horizontal side of said engaged cross wire from a second parallel segment whereby said each attaching portion is interlockingly engaged with said engaged cross wire and restrained from movement relative to said engaged cross wire.

10. A wire subassembly for use in a foundation for bedding and furniture comprising:

a grid including a border wire and cross wires arranged in a criss-cross pattern on said border wire;

a plurality of upright formed wire spring modules arranged in a predetermined pattern on said grid, each of said spring modules including an upright body portion and at least one attaching portion at the upper end of said body portion for attaching said spring modules to said grid;

said cross wires including substantially straight main portions with periodic vertical offsets each with a pair of first vertical offset portions, a curved second offset portion between said pair of first offset portions and vertically bent risers at each end of said vertical offsets for joining said first offset portions to said main portion; and each attaching portion of said spring modules including, beginning from said body portion, a first transverse segment, a first parallel segment, a second transverse segment and a second parallel segment relative to one of said cross wires, said attaching portion engaging said one cross wire with said first parallel segment engaging one horizontal side of one vertically bent riser with said first and second transverse segments on opposite vertical sides of said one cross wire and said second vertical offset portion being deflected vertically to entrap said second parallel segment of said attaching portion on the opposite horizontal side of said one cross wire from said first parallel segment.

11. The subassembly of claim 10 wherein said attaching portions further comprise from said second parallel segment;

a third transverse segment, a third parallel segment and a fourth transverse segment terminating at one end of said formed wire;

said second parallel segment engaging a horizontal side of a second bent riser with said third and fourth transverse segments on opposite vertical sides of said cross wire.

* * * * *